United States Patent [19]

Reinebach

[11] Patent Number: 4,811,895

[45] Date of Patent: Mar. 14, 1989

[54] MAILBOX SIGNALING DEVICE

[76] Inventor: Lewis C. Reinebach, Payson, Ill. 62360

[21] Appl. No.: 231,524

[22] Filed: Aug. 12, 1988

[51] Int. Cl.[4] ..... B65D 91/00

[52] U.S. Cl. ..... 232/35; 232/34

[58] Field of Search ..... 232/35, 34, 17

[56] References Cited

U.S. PATENT DOCUMENTS

| | | | |
|---|---|---|---|
| 1,627,617 | 5/1927 | Nordin | 232/35 |
| 2,804,262 | 8/1957 | Mancuso | 232/35 |
| 3,013,715 | 12/1961 | Ferenci | 232/35 |
| 3,084,853 | 4/1963 | Kopp | 232/35 |
| 4,190,193 | 2/1980 | Smith | 232/35 |
| 4,756,472 | 7/1988 | Hammons | 232/35 |

*Primary Examiner*—Robert W. Gibson, Jr.
*Attorney, Agent, or Firm*—Joseph W. Holloway

[57] ABSTRACT

A gravity operated mailbox signaling device which is actuated by opening the mailbox door, is resettable by one hand of an operator, and comprises a minimum number of parts, namely, an elongated signal arm in the form of a U-shaped channel and a single, bar-shaped member of considerable mass and weight. The arm is pivotably attached intermediate its ends to the mailbox; and, the member is pivotably attached to the non-signaling end of the arm and is disposed substantially interiorly of the U-shaped channel. The member coacts with a bracket mounted on the mailbox door to hold the signal arm in its non-signaling condition and to reset the arm after the same has been operated to its signaling condition. The member also shifts its center of gravity as the arm swings to its signaling condition to help maintain the arm in that condition until it is reset.

13 Claims, 2 Drawing Sheets

Fig. 1
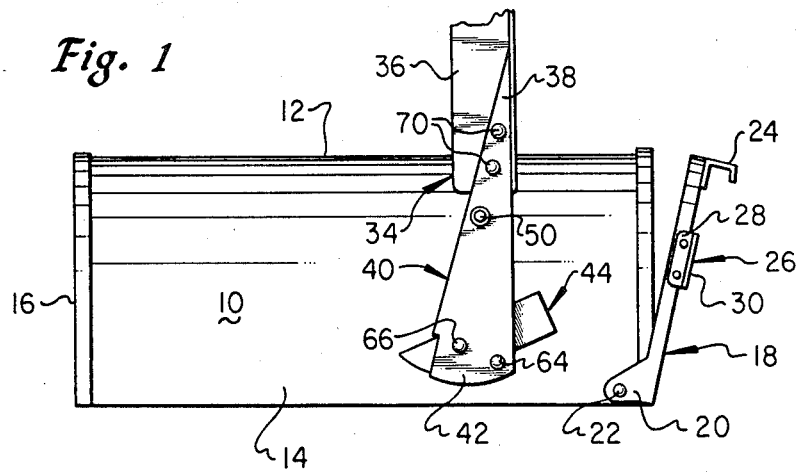
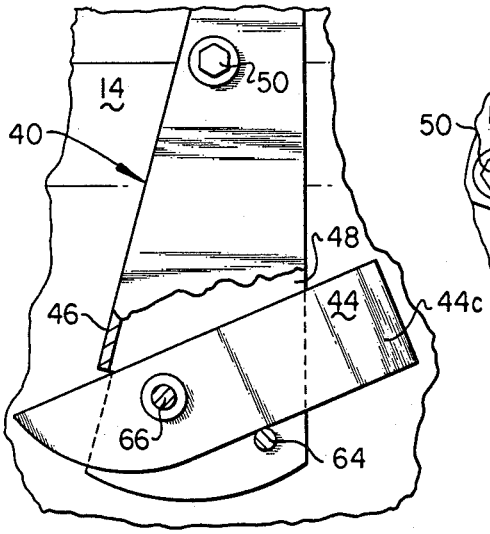
Fig. 2
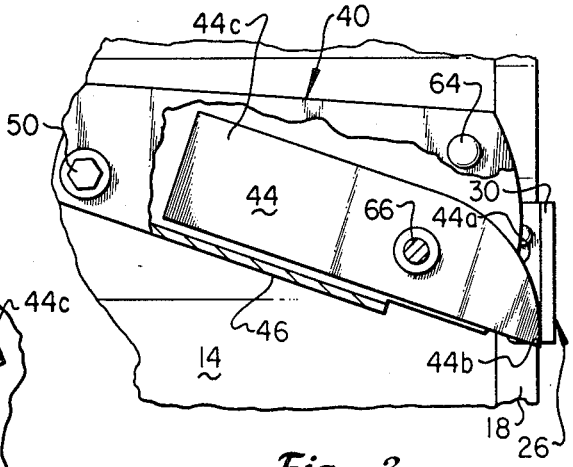
Fig. 3
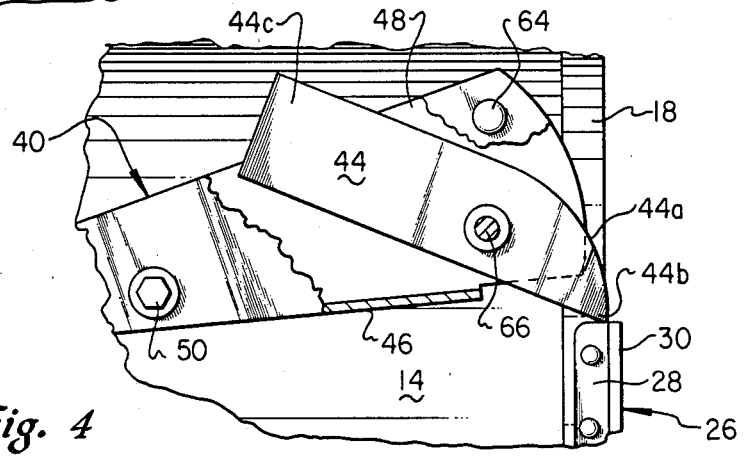
Fig. 4

MAILBOX SIGNALING DEVICE

BACKGROUND OF THE INVENTION

This invention relates generally to signaling devices of the type which indicate when the door of a mailbox has been opened and mail is present in the box. It is desirable that a remotely visible flag or other such signaling means be automatically displayed in response to opening of the door so that the mail carrier has no responsibility for actuating the signaling device. It is also desirable that the device be easily reset or cocked after the addressee removes the delivered items from the box without employing both hands in the resetting operation.

One prior art signaling device which incorporates the desirable features noted above is disclosed in U.S. Pat. No. 3,084,853 issued to P. E. Kopp on Apr. 9, 1963. Kopp shows an elongated signal arm pivotably mounted on a mailbox and swingable from a cocked horizontal position to a tripped vertical position. The non-signaling end of Kopp's arm carries a pawl which interfers with a strike bracket mounted on the box door whereby the arm is maintained in a horizontal position until the door is swung open. Upon opening the door, the arm is pivoted downwardly by gravitational force operating on a pair of weights attached to the non-signaling end of the arm. The first weight causes the arm to pivot to an upright or vertical signaling position while the second weight, due to a different moment arm, urges the arm against a stop to maintain its vertical orientation. To reset the Kopp device the signal arm is swung manually back to a horizontal position whereby the pawl, which is pivotably linked to the first weight, strikes the strike bracket and pivots about the non-signaling end of the arm to override the strike bracket there by assuming the cocked position.

While the Kopp device does provide automatic, gravity actuated signaling and resetting can be accomplished with only one hand, this device is overly complicated from a structural standpoint and is, therefore, unnecessarily costly to manufacture. Thus Kopp requires a pair of weights and means for individually mounting the same on his signal arm. Also complicating Kopp's device is the reset pawl which is pivotalby attached to the signal arm and is also pinned to a strap which carries one of the weights.

SUMMARY OF THE INVENTION

A general object of the invention is to provide a mailbox signaling device which overcomes the aforedescribed shortcomings of prior art signaling devices intended for the same purpose. More specifically, this invention provides improvements in the type of signaling device disclosed by Kopp in U.S. Pat. No. 3,084,853.

The principal object of this invention is to provide a gravity actuated signaling device which is resettable by the use of only one hand and which comprises a minimum of operating parts. To this end the invention comprehends a signal arm pivotably attached to a mail box and a single weight pivotably attached to the non-signaling end of the arm. The weight configured according to this invention is advantageously adapted to serve the combined functions of Kopp's pair of weights and also replaces the separate pawl and complicated linkage required by Kopp to interact with his strike bracket.

Another object is to provide a signal arm which carries at its non-signaling end a single weighted member which performs the following functions:

provides means coacting with the arm and a strike bracket on the mailbox door to hold the arm in the horizontal or nonsignaling position;

provides sufficient weight to cause the arm to pivot to the vertical or signaling position due to gravity acting on the member;

pivots with respect to the end of the arm to shift its center of gravity in a manner adapted to maintain the arm in a vertical position; and, cams with respect to the end of the arm during resetting or cocking of the arm to override the strike bracket.

Another important object is to provide a signaling device having a multifunctional, weighted member whereby the number of parts making up the device comprises an irreducible minimum.

Still another object is to provide an improved signaling device having the aforesaid characteristics which is practical and efficient in its use and operation, which is of simple construction and installation, and which can be mass produced at very low cost.

These and other objects and advantageous features of the invention will become apparent and the invention will be best understood and fully appreciated by having reference to the following detailed description of a preferred embodiment of the invention taken in conjunction with the accompanying drawings.

DESCRIPTION OF THE DRAWINGS

FIG. 1 is a fragmentary side elevation of a mailbox with the improved signaling device attached to one side thereof and device in the signaling position;

FIG. 2 is an enlarged fragmentary side elevational view of the signalling device shown in FIG. 1;

FIG. 3 is a fragmentary side elevational view with a portion of the signal arm broken away;

FIG. 4, is a view similar to FIG. 3 wherein the signal arm has been pivoted counterclockwise;

DETAILED DESCRIPTION OF THE INVENTION

Figure 5:
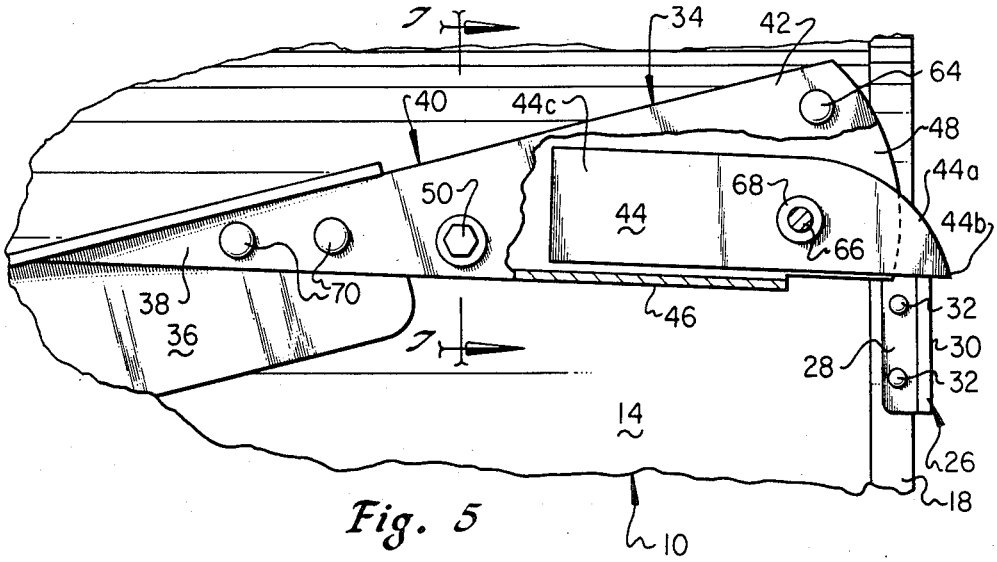
FIG. 5, is a view similar to FIGS. 3 and 4 showing the signal arm in the cocked or non-signaling position.
Figure 6:
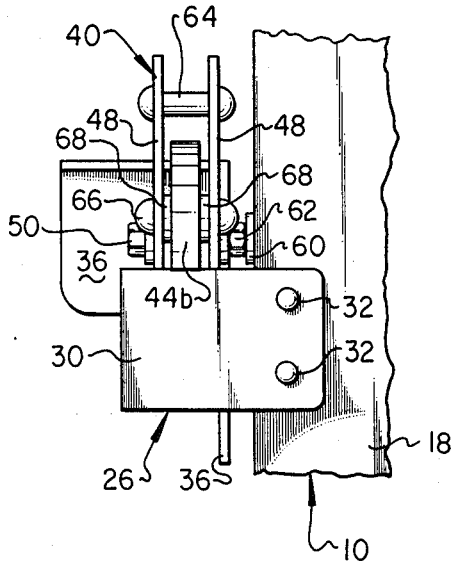
FIG. 6 is a partial end view of the signaling device in the position shown in FIG. 5; and, FIG. 7 is a partial sectional view taken along line 7—7 of FIG. 5.

A typical rural mailbox 10 is illustrated in FIG. 1 and generally comprises a curved top wall 12 with depending side panels 14, a flat rear closure wall 16, a flat bottom wall, not shown, and a manually operable front door 18. A pair of mounting feet 20 extend rearwardly from the base of door 18 and are pivotably secured to the opposed side walls 14 by pins or fasteners 22 so that the door 18 may be swung open and closed in a well-understood manner. A bracket 24 is suitably fixed to the upper portion of door 18 and provides an operating handle for the door. For a purpose to be described hereinafter, a strike bracket 26 is attached at the side of the door 18 slightly above its top to bottom centerline. Preferably, the bracket 26 is made by bending a generally rectangular piece of sheet meal to form a tab 28 which extends perpendicularly from the bracket body 30. As shown in FIGS. 5 and 6, the strike bracket 26 is rigidly affixed to the door 18 by securing the tab 28 to the side of door 18 and the body 30 to the door front by means of rivets 32 or other suitable fasteners.

The signaling unit, indicated in its entirety by numeral 34, generally comprises an angularly bent, sheet metal flag 36 secured adjacent the narrower or tailend 38 of a tapered pivot arm 40 which is secured intermediate its ends to a flat side panel 14 of the mailbox 10. The wider or head end 42 of the arm 40 carries a multipurpose, bar-shaped member 44.

Figure 7:
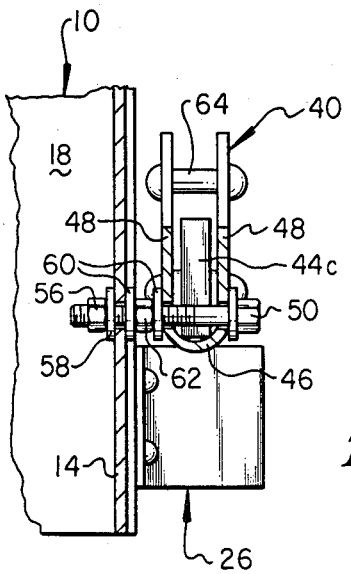

As best illustrated in FIG. 7, the pivot arm 40 comprises, in transverse cross section, a U-shaped channel having an arcuate bottom 46 and extending legs 48. As viewed in FIGS. 1 and 2, the channel opens forwardly or toward the door-end of the mailbox 10; and, as viewed in FIGS. 3 through 7, the channel opens upwardly or toward the top of the mailbox. FIG. 7 shows a bolt 50 extending through horizontally aligned openings in the channel legs 48 and mailbox side panel 14, respectively, for securing the arm 40 in swingable relation with the box 10. The end of bolt 50 penetrates the side panel 14 and receives a washer 56 and nut 58. Other washers 60 and a nut 62 are mounted on the bolt 50 to provide adequate spacing between the side panel 14 and the arm 40 and flag 36 to permit the signal unit 34 to swing alongside the mailbox 10.

The head end 42 of the arm 40 is arcuately shaped and is transversly penetrated by a fixed pin 64. The aforementioned bar-shaped member 44 is pivotably mounted intermediate the channel legs 48 on a pivot pin 66 between spacers 68. The pin 66 may comprise a rivet, a bolt or other such means. As shown in FIG. 5, for example, the major sides of member 44 are in the general shape of a rectangle except for a frontal nose **44*a* which curves downwardly to a tip 44*b*. For a purpose to be described, the transverse aperture through member 44 which receives the pivot pin 66 is displaced laterally from the longitudinal centerline of the member 44 toward the bottom wall 46 of the arm 40. It will also be noted that this transverse aperture is located forwardly of the lateral centerline of the member 44 or proximate the tip 44*b* of the member. The member 44 has a substantial thickness and is therefore quite massive and heavy compared to the sheet metal parts of the signaling arm 40**.

The head end 42 of member 44 is open between the side walls 48; and, a forwardmost segment of the bottom wall 46 is cut away to permit the nose **44*a* of member 44 to swing freely about the pivot pin 66 from the position shown in FIG. 5 to that shown in FIG. 2**.

The flag 36 may be of any desired shape, size and color which renders it visible from a considerable distance from the site of the mailbox. The preferred embodiment of such flag comprises a rectangle bent along its centerline so that the bent portions are perpendicular. The length of the flag may be quite substantial provided its weight does not become so great that it impedes the operation of the device, as will be described. The flag 36 is rigidly fixed to the tail end 38 of the arm 40 by rivits 70 or like fasteners.

The signaling unit 34 is installed on a standard mailbox by means of the single bolt 50 which pivotably secures the unit to the box. The strike bracket 26 is installed on the door 18 so that, once the signaling unit is in place, the member 44 rests atop the bracket 18 to support the arm 40 and attached flag 36 in the generally horizontal condition shown in FIG. 5. It will be appreciated that the unit 34 and the strike bracket are easily installed by use of simple tools and technics.

OPERATION OF THE INVENTION

In the drawings, FIGS. 1 and 2 show the signaling device in the vertical or tripped condition; and, FIGS. 5, 6 and 7 show the same in the horizontal or cocked or set condition. Assuming that the device is in the cocked or FIG. 5 condition, the forward tip **44*b* of the member 44 abutts with the top surface of the strike bracket 26. The underside of the member 44 engages with the bottom wall 46 of the arm 40 so that the arm and member coact to prevent the considerable weight of the member from pivoting the signaling unit 34 clockwise about the bolt 50. It is critical to proper operation of the signaling unit that the weight of the member 44 be much greater than that of the flag 36 to insure that the gravitational force available to pivot the arm 40 clockwise about bolt 50** is substantially greater than the opposed force.

When the addressee pivots the mailbox door 18 outwardly about pins 22 to retrieve the mailbox contents, the strike bracket body 30 is moved out of underlying supportive engagement with the nose **44*a* of member 44; and, the weight of member 44 acting on the pivot arm 40 causes the latter to pivot clockwise about the bolt 50 to the generally vertical or tripped condition shown in FIGS. 1 and 2. As the pivot pin 66 swings downwardly into approximate vertical alignment with the bolt 50, the member 44 will pivot clockwise about pin 66 due to the fact that pin 66 is displaced laterally from the longitudinal centerline of member 44 as noted hereinbefore. This is an important feature of the invention since the location of the center of gravity of the member 44 will be generally vertically aligned with the bolt 50 when the clockwise movement of the member 44 is arrested by striking the pin 64. With the center of gravity of the member 44 so situated, the pivots 50 and 66 lie on a line which is at an angle from vertical; however, the flag 36 will project vertically upwardly above the mailbox top 12 in the manner shown in FIG. 1. It will also be appreciated that the substantial weight of the member 44 will dampen any tendency of the signaling unit 34 to oscillate about bolt 50 due to wind acting on the flag 36**.

An important feature of this device resides in its ability to be reset or cocked from the vertical condition shown in FIGS. 1 and 2 to the condition shown in FIG. 5 by the use of only one hand of the operator. First the door 18 is pushed rearwardly to its closed position shown in FIGS. 3,4 and 5 whereby the body 30 of the strike bracket 26 is placed inside the arc of movement of the tip **44*b* of member 44. Manual force is then applied to either the flag 36 or the arm 40 to rotate the signaling unit 34 counterclockwise about bolt 50. During the course of such counterclockwise rotation from the tripped condition shown in FIG. 2, the tip 44*b*. of member 44 will strike the bracket body 30, as shown in FIG. 3, arresting the arcuate travel of the tip. As the pivot pin 66 continues to move in a counterclockwise arc about bolt 50, the member 44 will pivot clockwise about pin 66 sufficiently to permit the tip 44*b* to slide upwardly upon the surface of the bracket body 30 while the rear end 44*c* of the member 44 pivots upwardly between and beyond the spaced legs 48 of the arm 40. When the tip 44*b* clears and overrides the extreme upper surface of the strike bracket body 30, the member 44 will pivot counterclockwise about pin 66 due to the weight and long moment arm of the rear end portion 44*c* of the member 44; and, the arm 40 will pivot clockwise about bolt 50 until the lower surface of the member 44** contacts the bottom 46 of the arm 40 as shown in FIG. 5.

From the foregoing detailed description, it will be appreciated that the member 44 provides in one simply formed part an efficient means for coacting with the arm 40 and the strike bracket 26 to maintain the signaling unit 34 in a nonsignaling condition while it also provides the weight needed for pivoting the arm 40 to the signaling position and thereafter automatically shifts its center of gravity to maintain the signal flag in a preferred vertical position. Finally, the same member 44 cams with respect to the arm 40 during resetting of the arm 40 to override the strike bracket 26.

Another advantageous feature of this invention is the pivot arm 40 which, due to its tapered configuration and open interior construction, coacts with the member 44 to permit the member to project outwardly therefrom at the top, front and bottom of the arm as required to perform its various functions.

The foregoing description of the embodiments of the invention shown in the drawings is illustrative and explanatory only; and, various changes in the size, shape and materials, as well as in specific details of the illustrated construction may be made without departing from the scope of the invention.

What I claim as my invention is:

1. In combination with a mailbox having a side panel, a door swingable between open and closed positions, and a bracket mounted on said door, a signaling device comprising:

an elongated arm attached by first pivot means intermediate its ends to said side panel for swinging movement relative to said mailbox;

signal means disposed at one end of said arm;

weight means carried on second pivot means located proximate the other end of said arm; and, said weight means abutting said bracket when said door is closed for arresting swinging movement of said arm in a substantially horizontal position.

2. The combination according to claim 1, together with:

stop means on said arm for engagement with said weight means when said arm is in a substantially vertical position.

3. The combination according to claim 1, wherein:

said arm has an open interior; and said weight means is disposed substantially inside said arm.

4. The combination according to claim 1, wherein:

said weight means in generally rectangular in shape; and, said second pivot means transversly penetrates said arm and said weight means.

5. The combination according to claim 2, wherein:

the center of gravity of said weight means is in substantial underlying vertical alignment with said first pivot means when said weight means pivots about said second pivot means for engagement with said stop means.

6. The combination according to claim 2, wherein:

said weight means is generally rectangular and has longitudinal and lateral centerlines; and, said second pivot means extends through a transverse aperture in said weight means displaced from both of said centerlines.

7. The combination according to claim 3, wherein:

said arm is U-shaped in transverse cross section and has a bottom wall and spaced legs extending from said wall.

8. The combination according to claim 7, wherein:

said weight means comprises a flat, bar-shaped member disposed intermediate said legs; and, said second pivot means penetrates said member and said legs.

9. The combination according to claim 3, wherein:

said arm tapers along its length from a smaller tail end to a larger head end;

said signal means is attached to said tail end; and, said weight means is generally disposed inside said head end.

10. The combination according to claim 9, wherein:

said weight means has a portion projecting from said head end of said arm for abutting said bracket.

11. In combination with a mailbox having a side panel, a door swingable between open and closed positions, and a bracket mounted on said door and projecting laterally therefrom, a signaling device comprising:

an elongated arm attached intermediate its ends to said side panel for clockwise and counterclockwise rotation;

signal means attached to one end of said arm;

a weight member carried on a pivot pin disposed proximate the other end of said arm;

said weight member pivoting in one direction relative to said arm in response to sliding contact between said member and said bracket when said door is closed and said arm is rotated counterclockwise; and, said weight member pivoting in the opposite direction relative to said arm into overlying abuttment with said bracket when said arm is further rotated counterclockwise to terminate said sliding contact.

12. The combination according to claim 11, wherein:

said arm comprises a channel member;

said weight member is pivotably disposed within said channel member; and said weight member has an arcuate portion extendable from said other end for sliding contact with said bracket.

13. The combination according to claim 12, wherein:

said weight member has a wall which bears against a wall of said channel and a surface of said bracket to maintain said arm in a generally horizontal attitude.

* * * * *